US005507386A

United States Patent [19]

Foote

[11] Patent Number: 5,507,386

[45] Date of Patent: Apr. 16, 1996

[54] TAPE BOX AND TAPE DISPENSING APPARATUS AND METHOD OF MAKING SUCH APPARATUS

[75] Inventor: Richard W. Foote, Daytona Beach, Fla.

[73] Assignee: Automatic Business Products Co., Inc., New Smyrna Beach, Fla.

[21] Appl. No.: 506,618

[22] Filed: Jul. 24, 1995

Related U.S. Application Data

[63] Continuation of Ser. No. 277,439, Jul. 19, 1994, abandoned.

[51] Int. Cl.[6] ..... B65D 85/672

[52] U.S. Cl. ..... 206/394; 206/395; 206/409; 206/411

[58] Field of Search ..... 206/389, 391, 206/394, 395, 396, 397, 409, 411

[56] References Cited

U.S. PATENT DOCUMENTS

| | | | |
|---|---|---|---|
| 2,214,380 | 9/1940 | Nisbet | 206/391 X |
| 3,086,309 | 4/1963 | Katz | 206/397 X |
| 4,616,469 | 10/1986 | Skalleberg | 206/397 X |
| 5,129,515 | 7/1992 | Rutt et al. | 206/411 X |

*Primary Examiner*—Jacob K. Ackun
*Attorney, Agent, or Firm*—Alfred H. Hemingway, Jr,

[57] ABSTRACT

A tape dispensing apparatus including a tape container having tape dispensing apertures and a plurality of slots for partitions between rolls of tape. The partitions in the slots are individually formed from portions of boxes for the tapes. The portions of the boxes are integral with the boxes with the tapes therein but have lines of demarcation from the remainders of the boxes for being torn therefrom.

8 Claims, 2 Drawing Sheets

TAPE BOX AND TAPE DISPENSING APPARATUS AND METHOD OF MAKING SUCH APPARATUS

This application is a continuation of application Ser. No. 08/277,439, filed Jul. 19, 1994, now abandoned.

This invention relates to a tape dispensing apparatus and a disposable tape box and a method of making a tape dispensing apparatus for rolls of tape.

Pharmacists usually apply warning and/or instruction labels to pharmaceutical containers for the benefit of the user. Such labels may be preprinted and made available to the pharmacist in quick-release form on rolls of tape. A pharmacist using this system in its most effective form must store the label rolls in a readily accessible manner lending itself to convenient dispensing of the labels.

One previously known label dispenser is described in U.S. Pat. No. 3,231,130 to Foote, wherein a non-disposable container for storing and dispensing such labels has partitions which serve to space and orient the rolls within the dispenser. The partitions may be permanently affixed to the dispenser or releasably mounted through force-fit mechanical means described in the patent.

Still another known form of label dispenser provides a plurality of slots within which removable partitions may be inserted. Such a dispenser has in the past been completed by the pharmacist inserting in the dispenser label rolls individually blister-packed to a rigid backing shaped and sized to be accommodated by the slots in the dispenser. An alternative known method for completing such a label dispensing means is for the pharmacist to be provided separate roll partitions with loosely packed label rolls, which are inserted by the pharmacist into the dispenser slots on an as-required basis.

Blister packaging is relatively expensive and has come to be looked upon with some disfavor because of environmental concerns, such as the unnecessary use of material in the first instance and, in the second instance, disposal of the empty package. Similarly, the addition of separate partitions to boxed label rolls as shipped to pharmacists requires the use of additional material and additional costs associated with making the partitions and inserting them in the boxes.

It is an object of the present invention, therefore, to provide a new and improved tape dispensing apparatus which avoids one or more of the above mentioned disadvantages and limitations of prior such apparatus.

It is another object of the invention to provide a new and improved dispensing apparatus and a disposable tape box which minimizes the steps required in manufacturing the box and a partition for the tape dispensing apparatus.

It is another object of the invention to provide a new and improved method of making a tape dispensing apparatus for rolls of tape which is an easily utilized method.

In accordance with the invention, a tape dispensing apparatus comprises a tape container having tape dispensing apertures and having a plurality of slots for partitions between rolls of tape. The partitions in the slots are individually formed from portions of boxes for the tapes. The portions of the boxes are integral with the boxes with the tapes therein but have lines of demarcation from the remainders of the boxes for being torn therefrom.

Also in accordance with the invention, a disposable tape box comprises a disposable box having lines of demarcation for a portion of the box which is removable from the box and is insertable in a container for tapes to form partitions between the tapes.

Also in accordance with the invention, a method of making a tape dispensing apparatus for rolls of tape comprises utilizing a container for rolls of tape having a plurality of tape dispensing apertures therein and having a plurality of slots therein for partitions between rolls of tape. The method also includes tearing portions of a plurality of disposable tape boxes from the remainder of said boxes to form said partitions and disposing of partitions in the slots with rolls of tape therebetween.

For a better understanding of the present invention, together with other and further objects thereof, reference is made to the following drawings, taken in connection with the accompanying description, and its scope will be pointed out in the appended claims.

Referring now to the drawings.

Figure 1:
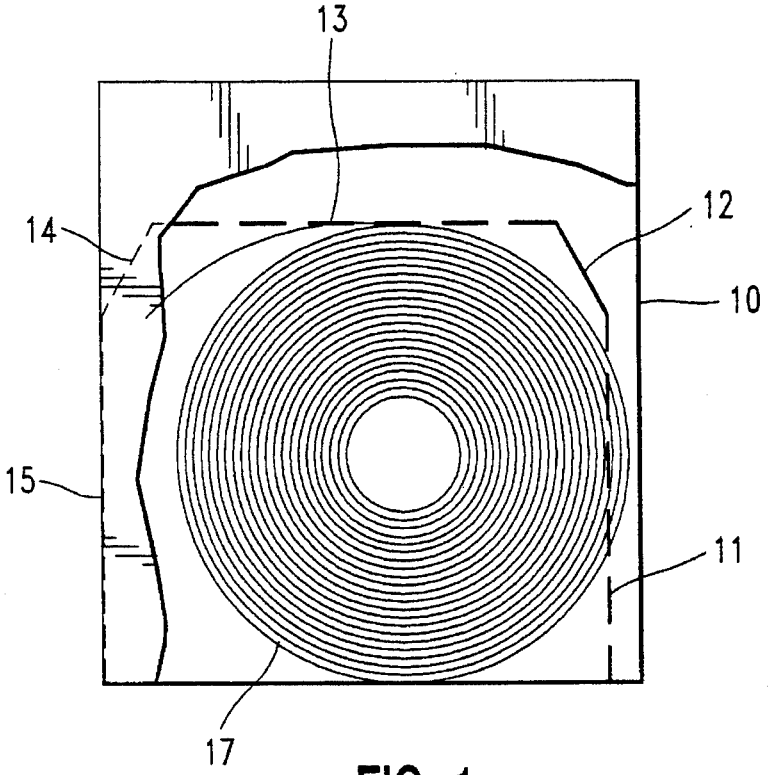
FIG. 1 is a fragmentary plan view of a disposable tape box containing one or more tape rolls as delivered to a pharmacist.
Figure 2:
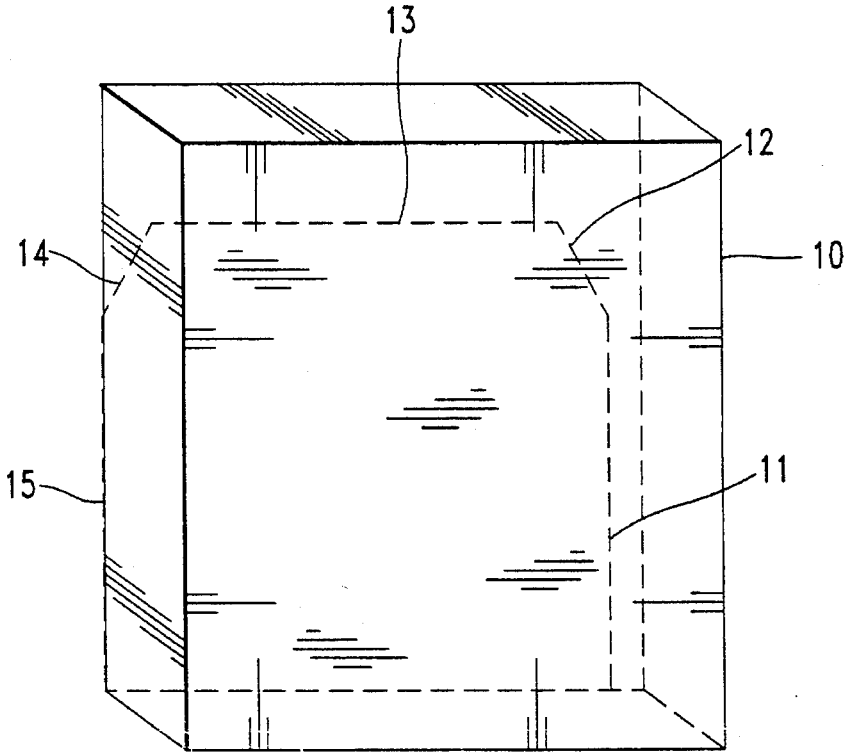
FIG. 2 is a fragmentary perspective view of the FIG. 1 box.

Referring now more particularly to FIGS. 1 and 2, a disposable tape box 10 in accordance with the invention may, for example, be a box of rectangular shape of sufficient height and length to contain one or more rolls of tape 17 as represented in the fragmentary view of FIG. 1. The box may, for example, be made of cardboard and have a generally right rectangular parallelipiped configuration.

The disposable box 10 has lines 11, 13, and 15 which preferably are perforations for a portion 16 of the box enclosed by those lines which is removable from the box and is insertable in a container for tapes to form partitions 16 between the tapes. Lines 12 and 14 preferably are individually continuous knife cuts between lines 11 and 13 and between lines 13 and 15. A single roll of tape 17 is represented in FIG. 1.

Figure 3:
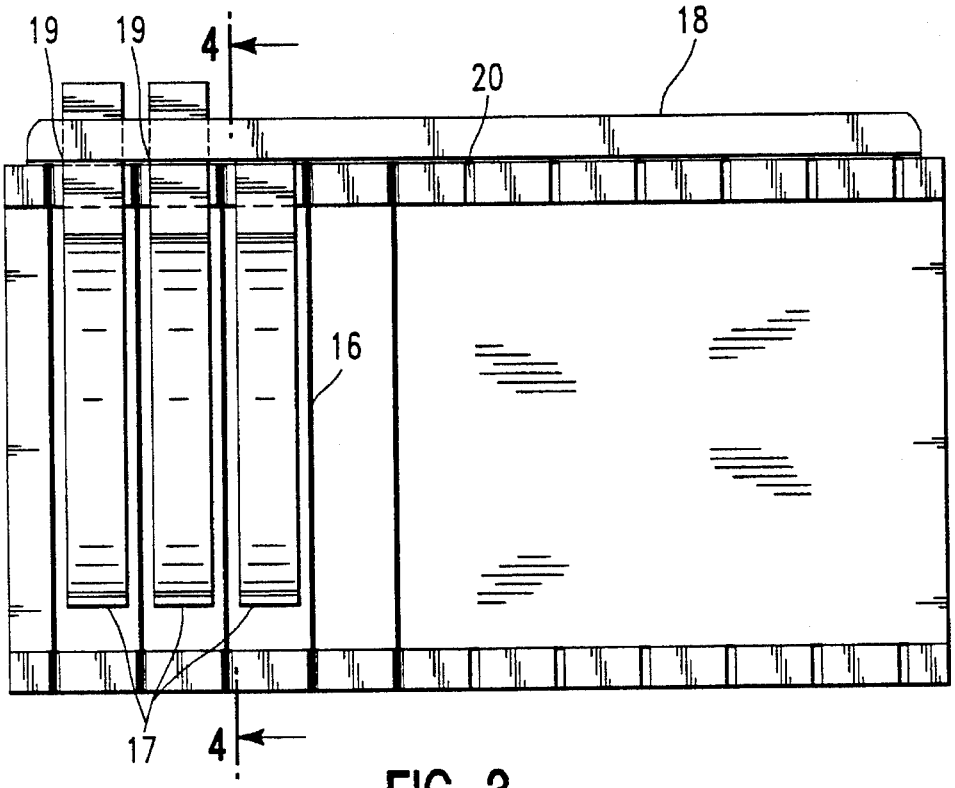
FIG. 3 is a plan view of a container which the pharmacist is provided for dispensing labels from a plurality of tape rolls.
Figure 4:
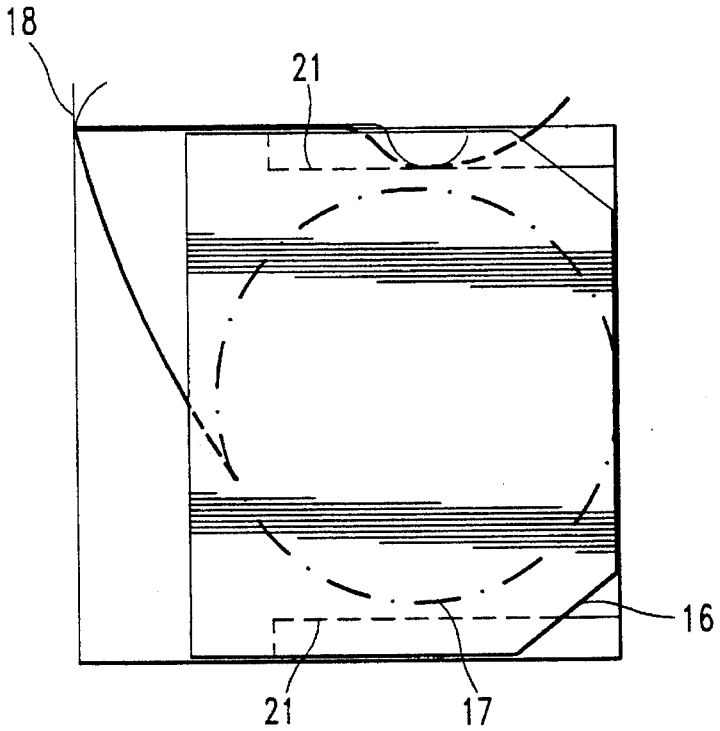
FIG. 4 is a sectional view of the FIG. 3 container, taken along line 4—4 of FIG. 3.

Referring now more particularly to FIGS. 3 and 4 of the drawings, a tape dispensing apparatus comprises, for example, a tape container 18 of metal or other rigid material having tape dispensing apertures 19 and having a plurality of slots 20 for partitions between rolls of tape. The slots 20 also extend between inner walls 21 of the container 18. The partitions 16 in the slots 20 are individually formed from portions of boxes 10 for the tapes. The portions of the boxes are integral with the boxes with the tapes therein but have lines of demarcation from the remainder of the boxes for being torn therefrom.

The method of making the tape dispensing apparatus for rolls of tape comprises utilizing a container, for example a container 18 as shown in plan view in FIG. 3, for rolls of tape 17 having a plurality of tape dispensing apertures 19 therein and having a plurality of slots 20 therein for partitions between rolls of tape, and includes tearing portions of a plurality of disposable tape boxes from the remainder of said boxes to form the partitions 16 and disposing the partitions in the slots with rolls of tape therein.

From the foregoing description it will be seen that the box serves a dual function as a shipping box for one or more rolls of tape and as a perforated portion which is used as a partition between rolls of tape in a tape dispensing apparatus.

While there has been described what is at present believed to be the preferred embodiment of this invention, it will be obvious to those skilled in the art that various changes and modifications may be made therein without departing from the invention, and it is, therefore, aimed to cover all such changes and modifications as fall within the true spirit and scope of the invention.

I claim:

1. A combination for shipping, storing and dispensing rolls of tape provided to the user in a disposable box, said combination comprising:

(a) a tape storage and dispensing container for a plurality of rolls of tape, said container having tape dispensing apertures and a plurality of slots for accepting at least one partition between rolls of tape stored in the container; and (b) a disposable box for at least one roll of tape, the box being adapted to provide a partition for use in the storage and dispensing container and comprising a plurality of sides, at least one of the sides having lines defining a portion of the side which is separable from the remainder of the box, the shape of the separable portion being adapted for the insertion of the separated portion into the storage and dispensing container as a partition for rolls of tape stored in said container.

2. A combination according to claim 1, wherein said container comprises at least one partition adapted to and slidably inserted into said slots, said partition consisting of a portion of said disposable box separated from the remainder of said box.

3. A combination according to claim 1, wherein said defining lines of said disposable box include at least one perforated line.

4. A combination according to claim 1, said disposable box having six planar, substantially rectangular sides and a generally right rectangular parallelepiped configuration when closed.

5. A combination according to claim 4, said separable portion of said disposable box having a flat, substantially two-dimensional, six-sided shape.

6. A combination according to claim 5, said six-sided shape consisting essentially of a rectangle with two truncated corners.

7. A combination according to claim 6, wherein said lines defining said six-sided separable portion comprise a plurality of perforated lines.

8. Method of making a tape dispensing apparatus for rolls of tape comprising:

utilizing a container for rolls of tape having a plurality of tape dispensing apertures therein and having a plurality of slots therein for partitions between rolls of tape;

tearing portions of a plurality of disposable tape boxes from the remainder of said boxes to form said partitions;

and disposing said partitions in said slots with rolls of tape therebetween.

* * * * *